United States Patent [19]

Wehrli

[11] Patent Number: 5,048,157

[45] Date of Patent: Sep. 17, 1991

[54] DRAFTING ARRANGEMENT FOR SPINNING MACHINES

[75] Inventor: Rudolf Wehrli, Winterthur, Switzerland

[73] Assignee: Rieter Machine Works, Ltd., Winterthur, Switzerland

[21] Appl. No.: 377,541

[22] Filed: Jul. 10, 1989

[30] Foreign Application Priority Data

Jul. 15, 1988 [CH] Switzerland ..... 02723/88

[51] Int. Cl.[5] ..... D01H 5/72

[52] U.S. Cl. ..... 19/288; 19/258; 19/252; 19/249

[58] Field of Search ..... 19/236, 244, 249, 251, 19/252, 258, 288

[56] References Cited

U.S. PATENT DOCUMENTS

| | | | |
|---|---|---|---|
| 1,559,281 | 10/1925 | Rushton | 19/245 |
| 4,430,774 | 2/1984 | Bothner | 19/105 |
| 4,484,376 | 11/1984 | Glock et al. | 19/0.25 |
| 4,642,852 | 2/1987 | Turner et al. | 19/236 |

FOREIGN PATENT DOCUMENTS

| | | |
|---|---|---|
| 514891 | 11/1952 | Belgium . |
| 537982 | 5/1955 | Belgium . |
| 107828 | 3/1986 | European Pat. Off. . |
| 98477 | 10/1897 | Fed. Rep. of Germany . |
| 742141 | 10/1943 | Fed. Rep. of Germany . |
| 1006766 | 2/1954 | Fed. Rep. of Germany . |
| 2125616 | 12/1972 | Fed. Rep. of Germany . |
| 1118008 | 5/1956 | France . |
| 0350904 | 1/1961 | Switzerland . |
| 107276 | 6/1917 | United Kingdom . |
| 0694817 | 7/1955 | United Kingdom . |
| 0883823 | 12/1961 | United Kingdom . |
| 993844 | 6/1965 | United Kingdom . |
| 1378177 | 12/1974 | United Kingdom . |

OTHER PUBLICATIONS

Wegener, Dr. Ing. W., "Die Streckwerke der Spinnereimaschinen", (1965, Springer Verlag, Seite 315).

*Primary Examiner*—Werner H. Schroeder
*Assistant Examiner*—Michael Neas
*Attorney, Agent, or Firm*—Kenyon & Kenyon

[57] ABSTRACT

The drafting arrangement is provided with a guide element between the front roller pair and the operative unit formed by an apron and a roller. The guide element is disposed for guiding a length of fiber between the roller of the operative unit and the front roller pair. The guide element may be of D-shaped cross-section, circular cross-section or in the form of a curved plate. Where cylindrical, the guide element may also be rotated.

18 Claims, 5 Drawing Sheets

DRAFTING ARRANGEMENT FOR SPINNING MACHINES

This invention relates to a drafting arrangement for spinning machines. More particularly, this invention relates to a drafting arrangement for spinning machines for producing relatively fine yarns from short staple fibres, for example, jet spinning machines for processing fibers up to 60 millimeters fiber length.

When a yarn is to be produced from a continuous fiber structure (sliver or feed material or roving) without an "open end", a drafting arrangement for reducing the thickness of the structure is usually provided before the actual spinning stage. For example, Swiss Patent 350,904 and British Patents 883,823 and 694,817 describe various types of arrangements for this purpose. It is also known from European Patent 107 828 that yarn guidance in the final draft zone of the drafting arrangement is very important in the production of relatively fine yarns. This patent therefore proposes an arrangement providing significant advantages as compared with a double-apron drafting arrangement.

A double apron drafting arrangement is, at present, the standard construction for ring spinning machines. It is therefore relatively obvious to use such familiar drafting arrangements for more recent spinning processes such as jet spinning. However, this has its disadvantages, more particularly the problems of periodic replacement of the bottom apron, something which is difficult to remove from and refit in the overall arrangement.

Other drafting arrangements are known and have various advantages over the double apron drafting arrangement but have so far proved unable to equal the technological performance of the double apron drafting arrangement, more particularly as regards fiber guidance.

Accordingly, it is an object of this invention so to improve fiber guidance in a drafting arrangement.

It is another object of the invention to improve the technological performance of a drafting arrangement to at least that of a double apron drafting arrangement.

It is another object of the invention to provide a drafting arrangement which retains the operating advantages of a KEPA drafting arrangement over a double apron drafting arrangement.

Briefly, the invention provides a drafting arrangement comprised of an operative unit, for instance, in the form of a pair of rollers, which occupies a converging space and a second operative unit which precedes the first operative unit as considered in the direction of fiber flow and which comprises a roller and an apron cooperating therewith. The two operative units can together form the final draft zone of the drafting arrangement although this is not essential in the widest sense. In addition, the drafting arrangement has a yarn-guiding element provided between the exit of the second-mentioned operative unit and the entry or nip of the following operative unit.

Preferably, the yarn-guiding element presents a guide surface to the fibers between the exit of the preceding operative unit and the entry, as a rule, the nip line, of the following operative unit. This surface should be curved in the fiber flow direction. In the simplest case, the surface is of constant radius, but more complicated shapes can be used to improve guidance.

The guide element can be in the form of rod or bar or the like which can be introduced between the operative units. However, the element could be of strip-like cross-section.

The term "guide element" is not necessarily to be understood in this connection as an "unitary element". While a unitary element is preferred, the element can be devised from a number of cooperating components. However, the presence in the fiber-guiding surface of discontinuities is certain to be disadvantageous since individual fibres may catch in such discontinuities.

The guide element can be so arranged as to strip off from the roller of the preceding operative unit, the fibers delivered thereby, but without contacting the latter roller, and to convey the fibers thus stripped into the converging space of the following operative unit. The stripping and guiding functions of the guide element can be dependent upon air conditions—i.e., on the airflows in the gap between the operative units. The guide surface can therefore be a surface facing away from the apron.

Very advantageously, the fiber-guiding element is effective as a confining element to confine the transverse width of the fiber flow—i.e., the fiber-guiding element is also effective as a condenser.

These and other objects and advantages of the invention will become more apparent from the following detailed description taken in conjunction with the accompanying drawings wherein.

Figure 1:
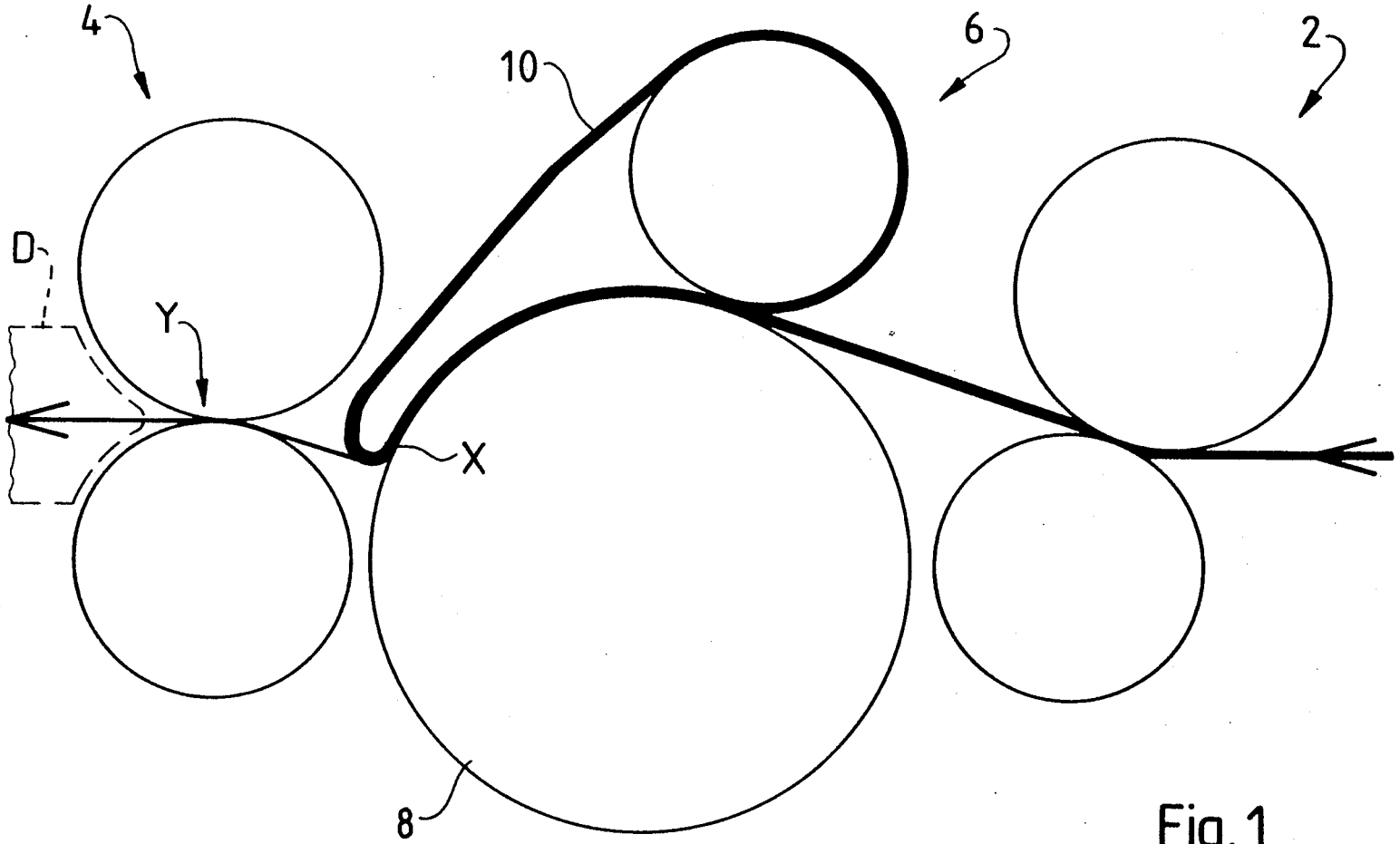
Fig. 1 Prior Art
FIG. 1 illustrates a cross-sectional view of a KEPA drafting arrangement.

Referring to FIG. 1, the two-zone drafting arrangement of a spinning machine comprises a pair of back rollers 2, a pair of front rollers 4 and an operative unit 6 disposed between the roller pairs 2, 4. The unit 6 comprises a roller 8 which can take the form, for example of a portion of a cylinder extending over the length of the machine or of a roller provided for each spinning position. An apron 10 co-operates with the roller 8 to form the operative unit 6.

The drafting arrangement shown in FIG. 1 is known as a KEPA drafting arrangement, for example, from the book "Die Streckwerke der Spinnerreimaschinen" by Dr. Ing. W. Wegener (Ausgabe 1965, Springer Verlag, Seite 315) for ring spinning or flyer spinning with long staple fibers. A disadvantage of this arrangement particularly so far as the spinning of relatively fine short-staple yarns is concerned is unsatisfactory yarn guidance between the exit of the unit 6 and the entry of the front roller pair 4—i.e., between, on the one hand, the final contact line X between the apron 10 and the roller 8 and, on the other hand, the nip line Y of the front roller pair 4. The unsatisfactory yarn guidance is the result of a geometrically determined excessive uncontrolled length of fiber structure between the units 6 and 4. This arrangement is therefore not suitable for jet spinning, devised as it is more particularly for the production of relatively fine yarns. The roving issuing from the front roller pair 4 is received by a jet system and twisted to form a yarn. A jet element D is indicated merely in chain lines in FIG. 1. Similar considerations apply to false twist spinning in general—i.e., irrespective of whether or not jets are used to produce the false twist effect. However, the variations from this prior art which will be described hereinafter may be advantageous in conventional spinning (ring spinning).

Figure 2:
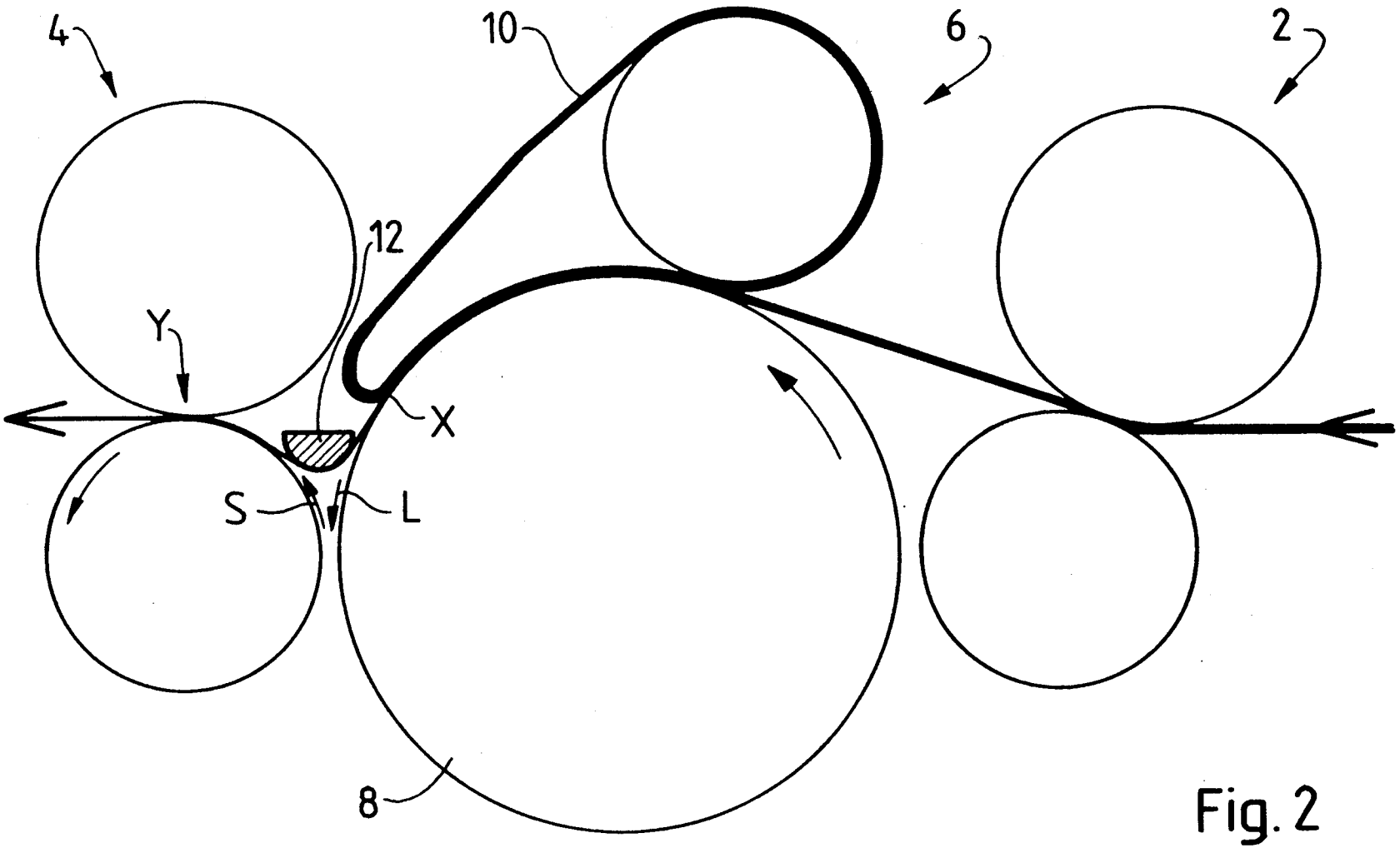
FIG. 2 illustrates a cross-sectional view of a drafting arrangement employing a guide element in accordance with the invention.

Referring to FIG. 2, the drafting arrangement includes a first operative unit in the form of a roller pair 4 occupying a converging space, a second operative unit 6 upstream of the roller pair 4 and a pair of back rollers 2. The operative unit 6 includes a roller 8 and an endless apron 10 which is disposed to lie over the roller 8 so as to guide a continuous length of fiber therebetween to the front roller pair 4. In addition, a guide element 12 is interposed between the units 4, 6 for guiding the length of fiber therebetween. More specifically, the guide element 12 is interposed between an exit X from between the apron 10 and the roller 8 and the entry Y to the nip between the roller pair 4. As illustrated, the element 12 is in the form of a D-shaped rod having a plane surface facing upwards, that is towards the apron 10, while a curved surface faces downwardly, that is, away from the apron 10. Tests have shown that the fibers issuing from the unit 6 follow the curved surface of the bar 12 into the converging space and, therefore, into the nip line of the front roller pair 4. The following explanation of this unexpected phenomenon is offered without any limitation of the scope of protection.

As viewed in FIG. 2, the roller 8 and the bottom front roller of the pair 4 rotate anticlockwise, as indicated by arrows on the respective rollers. The rotation of the roller 8 produces an air flow L shortly after the exit line X which also flows anticlockwise in FIG. 2. The rotation of the bottom roller of the front pair 4 produces an air flow S which also flows anticlockwise in FIG. 2 but in the opposite direction to the flow L. The fibers (not shown) issuing from the unit 6 first try to follow the air flow L and move along the surface of the roller 8. However, the effect of the flow L decreases shortly after passing by the element 12 whereas the effect of the flow S, which is much stronger because of the nature of the process, builds up in this zone. The fibers are stripped by the flow S from the roller 8 and by way of the curved surface of the bar 12 placed on the surface of the bottom front roller and thus conveyed to the nip line Y. The effect of the element 12 is therefore mainly to act on air conditions in the gap between the units 6, 4 and, more particularly, to facilitate the air flows required for stripping and introduction into the nip line Y.

Figure 3:
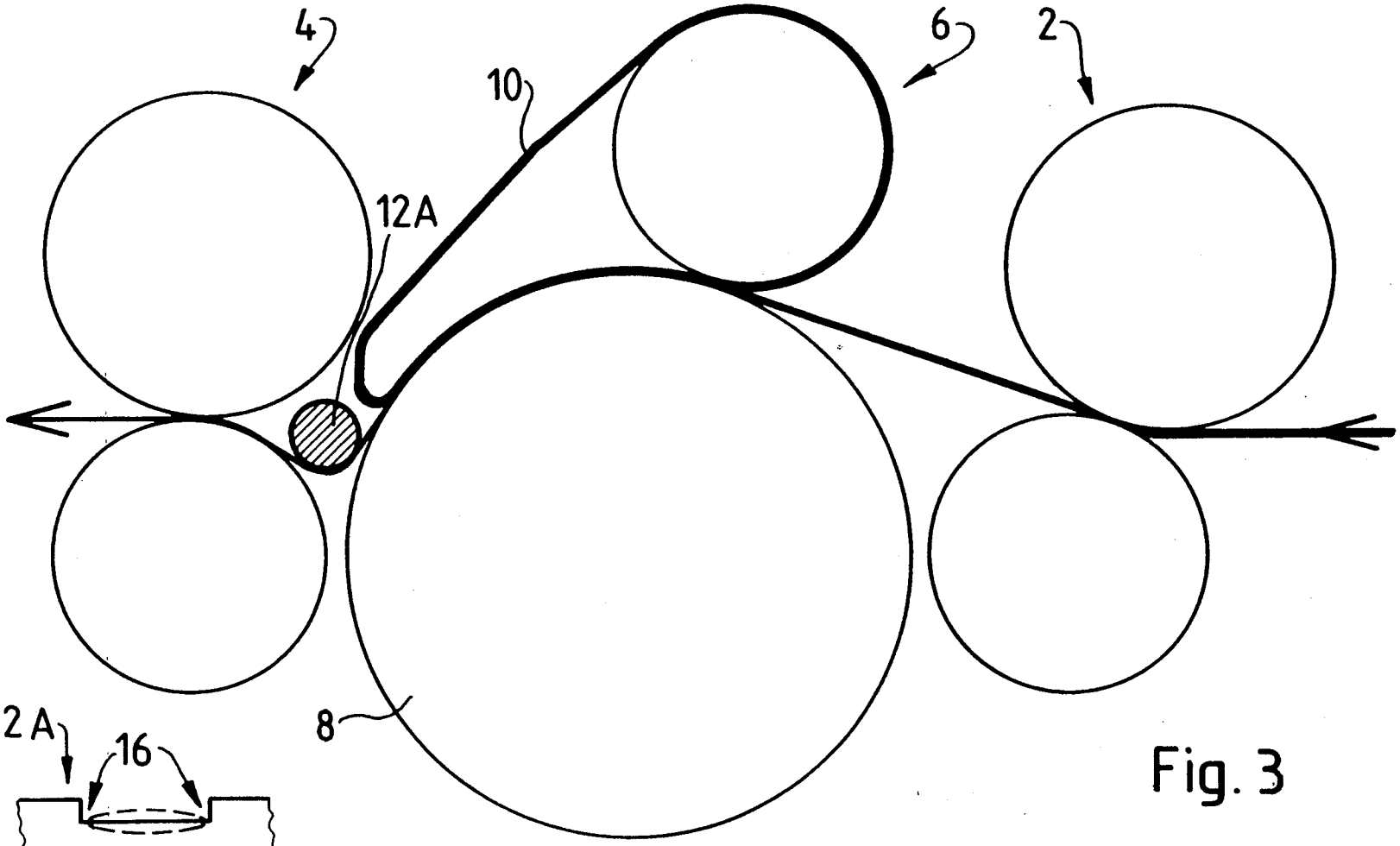
FIG. 3 illustrates a drafting arrangement employing a modified guide element in accordance with the invention.
Figure 3A:
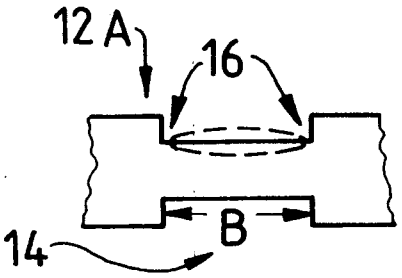
FIG. 3A illustrates a partial view of a modified guide element in accordance with the invention.

Referring to FIG. 3 wherein like reference characters indicate like parts as above, the guide element 12A is of round cross-section and not D-shaped. The effect is the same as above. FIG. 3A shows another advantageous modification, wherein the bar 12A has a central section of reduced cross-section for guiding the fiber. The annular surfaces 16 of the end zones are therefore effective as a means for confining fiber flow and defining the maximum width B thereof—i.e., of the feed material to be drafted—in the second zone of the drafting arrangement. The reduced-diameter section can be cylindrical, as indicated in solid lines, or concave or convex, as indicated in chain lines, or have a shape comprising various curvatures. Fiber distribution on the front roller pair 4 can be controlled in this way.

Preferably, the bar 12A remains stationary in operation to facilitate the construction of the drafting arrangement. However, the bar 12A could be rotated around a longitudinal axis in operation. When the bar 12A is rotated clockwise in FIG. 3, the associated air flows amplify the previously mentioned air flows L, S. When rotated anticlockwise, the bar 12A opposes the flows L, S, probably with disadvantageous effects.

Figure 4:
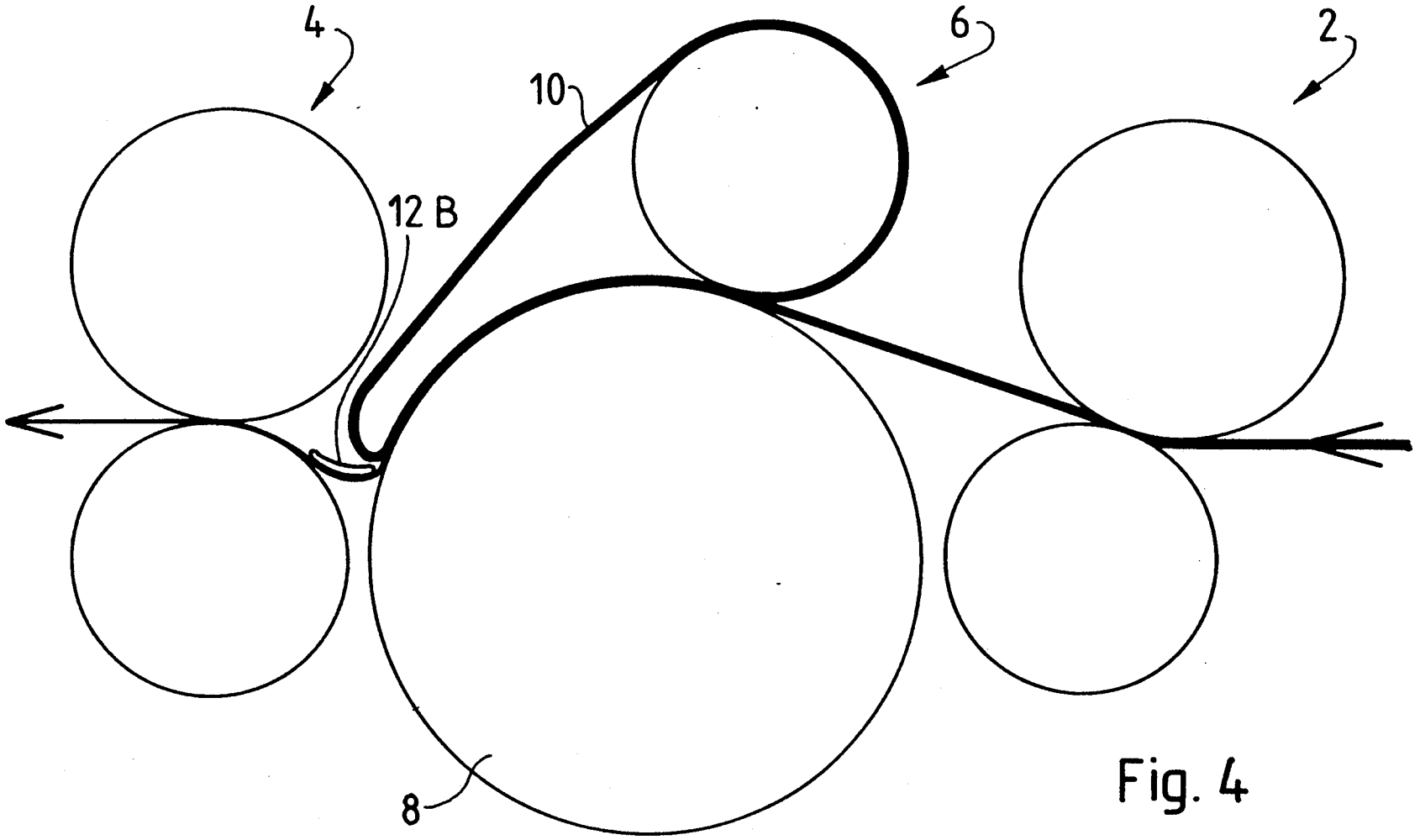
FIG. 4 illustrates a drafting arrangement employing a further modified guide element in accordance with the invention.

Referring to FIG. 4, wherein like reference characters indicate like parts as above, the yarn-guiding element 12B may be in the form of a curved plate disposed between the units 6, 4. The effect is the same as that provided by the arrangement of FIG. 2.

All the constructions shown in FIGS. 2 to 4 have curved guide surfaces of constant radius. However, the constant radius feature is not essential. The radius of the guide surface could be adapted to facilitate optimum guidance of the fibers, for example, from the exit of the unit 6 and/or into the entry of the front roller pair 4. In all the variants shown (including the variant shown in FIG. 5, to be described hereinafter), the longitudinal axes (not specially shown) of the bottom rollers are coplanar although the diameter of the roller 8 is considerably greater than the diameters of the other two bottom rollers. This constructional feature helps to simplify the complete arrangement but is not essential; a different and feasible arrangement is disclosed in Dr. Wegener's book hereinbefore referred to.

Figure 5:
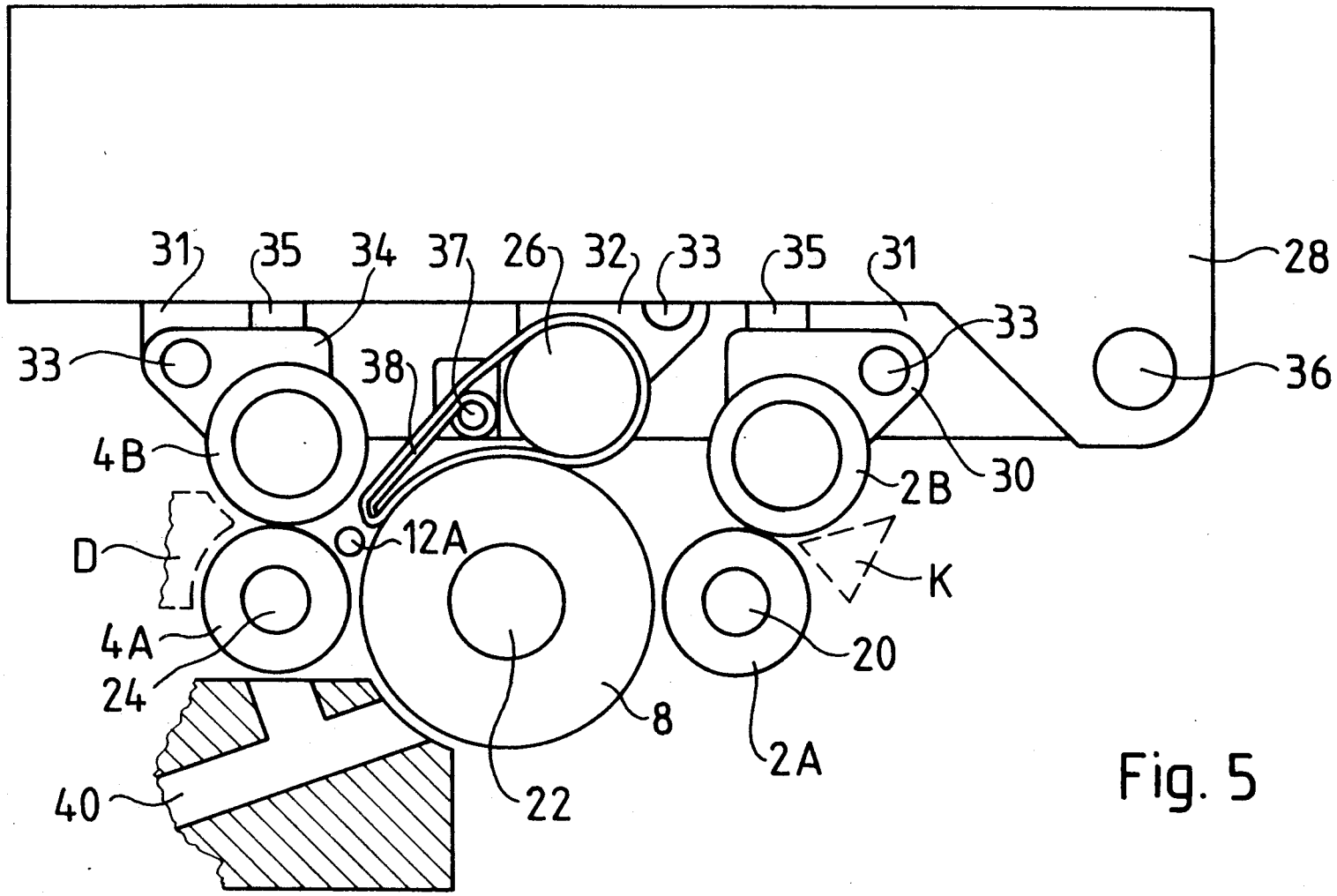
FIG. 5 illustrates a diagrammatic side elevation of a drafting arrangement construction embodying the principle of FIG. 2.

FIG. 5 shows in a simplified diagrammatic view a practical example of a drafting arrangement constructed in accordance with the above arrangement. Each bottom roller 2A, 8, 4A is disposed on a corresponding drive shaft 20, 22, 24 disposed in the machine frame (not shown). Each of the top rollers 2B, 26, 4B is retained on a bracket or the like 30, 32, 34 carried by a swing arm 28. The arm 28 is pivotable around a pivot 36 to open the drafting arrangement and to press the top rollers onto the bottom rollers. A carrier plate 31 disposed on the arm 28 has three pins 33 which extend parallel to the pivot 36. The brackets 30, 32, 34 are each pivotally suspended on a pin 33 and urged by spring-loaded elements 35 towards the bottom rollers 2A, 8, 4A (only the biasing or urging elements 35 for the brackets 30, 34 are visible in FIG. 5).

An endless apron 10 runs around the top roller 26 and a guide bridge 38 carried by the arm 28 by way of the plate 31. The bridge 38 is rotatably mounted on a pin 37 urged towards the roller 8 by a loading element 39 (shown only diagrammatically). In the preferred variant, the rollers are mounted in overhung fashion on their brackets.

The guide bar 12A of FIGS. 3 and 3A could be so mounted on the arm 28 by way of a corresponding bracket (not shown) as to pivot with the arm 28 around the pivot 36. Preferably, however, the bar 12A is mounted in the machine frame so that gaps remain between the bar 12A and the rollers 8, 4A. Preferably, the latter gaps are of the order of from 0.1(mm) to 0.5 millimeter (mm) while the roller 8 for processing short staple fibres has a diameter of from 50 to 60 millimeters (mm) and the roller 4A a diameter of 25 to 30 millimeters (mm). For processing long-staple fibers, the roller 8 can have a diameter of approximately 150 millimeters (mm).

As indicated in FIG. 5, an extractor 40 is provided for removing any fibers sticking to the surfaces of the rollers 8 and 4A. A condenser K shown in chain lines can be disposed before the back roller pair 2 to enable a feed material (not shown) for drafting to be guided cleanly into the drafting arrangement with a width determined by the condenser. A jet D (shown only in chain lines) takes over the fibers from the front roller pair 4.

In all the arrangements, the gaps between the exit of the unit 6 and yarn-guiding element 12 and between the yarn-guiding element 12 and the entry of the unit 4 are as small as permitted by the geometry of the arrangement and by the dimensions of the elements.

The roller 8 as in the KEPA drafting arrangement must be in the form of a so-called "adhering roller", made of rubber or steel or some other material with a surface treated to optimize fiber adhesion. The required effect can be provided in a steel roller by sand blasting or coating, for example, by plasma or diamond coating.

The invention thus provides a drafting arrangement having an improved fiber guidance arrangement. Further, the invention provides a drafting arrangement capable of improved technological performance which is at least equal to that of a double-apron drafting arrangement.

What is claimed is:

1. A drafting arrangement for reducing the thickness of a fiber structure delivered to a spinning stage of a spinning machine for producing relatively fine yarns comprising a first operative unit having a pair of rollers defining a converging space for guiding a continuous length of fiber therebetween;

a second operative unit adjacent said first unit, said second unit including a large friction roller and an endless apron partly embracing said roller to cooperate therewith to deliver a length of fiber to said first unit; and a guide element interposed between said units for guiding a length of fiber therebetween, said guide element being disposed in a converging gap between said roller of said second unit and one roller of said first unit to deflect the length of fiber over said element and between said units.

2. A drafting arrangement as set forth in claim 1 wherein said guiding element has a curved guide surface.

3. A drafting arrangement as set forth in claim 2 wherein said element confines the width of a fiber flow to be drafted.

4. A drafting arrangement as set forth in claim 2 wherein said guide surface is cylindrical.

5. A drafting arrangement as set forth in claim 2 wherein said guide surface is remote from said apron.

6. A drafting arrangement comprising a first pair of rollers forming a nip for passage of a continuous length of fiber to be drafted;

an operative unit for feeding a continuous length of fiber to said nip of said first pair of rollers, said unit including a rotatably mounted large friction roller and an endless apron opposite said roller for guiding the length of fiber therebetween; and a guide element interposed between said pair of rollers and said unit for guiding the length of fiber to said nip, said guide element being disposed in a converging gap between said roller of said operative unit and one roller of said pair of rollers to deflect the length of fiber therebetween and over said element.

7. A drafting arrangement as set forth in claim 6 wherein said element is a D-shaped rod having a curved surface for guiding the fiber thereon.

8. A drafting arrangement as set forth in claim 6 wherein said roller of said unit and an opposed lower roller of said pair of rollers rotate in the same direction of rotation and said guide element is disposed in a gap defined between said roller of said unit and said lower roller of said pair of rollers.

9. A drafting arrangement as set forth in claim 6 wherein said element is of cylindrical cross-section.

10. A drafting arrangement as set forth in claim 9 wherein said element is rotatably mounted to rotate in a direction opposite to the direction of rotation of said roller of said unit.

11. A drafting arrangement as set forth in claim 6 wherein said element has a central section of reduced cross-section for guiding the fiber thereon.

12. A drafting arrangement as set forth in claim 6 wherein said element is a curved plate.

13. A drafting arrangement as set forth in claim 6 wherein said roller of said unit and an opposed lower roller of said pair of rollers are disposed on axes located in a common horizontal plane.

14. A drafting arrangement as set forth in claim 6 wherein said guide element has a curved surface facing said roller of said operative unit to define a passage for the length of fiber guided therefrom and facing one of said rollers to define a passage for delivering the length of fiber to said nip.

15. A drafting arrangement as set forth in claim 14 wherein said guide element is stationary.

16. A drafting arrangement comprising a plurality of bottom rollers including a large friction roller;

a swing arm pivotably mounted above said rollers;

a plurality of top rollers mounted on said swing arm in opposition to said bottom rollers;

an endless apron disposed about one of said top rollers in facing and partly embracing relation to said large friction bottom roller to form an operative unit to guide a length of fiber therebetween; and a guide element disposed in a converging gap between said large bottom roller of said operative unit and a first of said bottom rollers to guide and deflect the length of fiber over said element to a nip between said first bottom roller and an opposed one of said top rollers.

17. A drafting arrangement as set forth in claim 16 which further comprises an extractor opposite said bottom roller of said unit and said first bottom roller for removing fibers sticking thereto.

18. A drafting arrangement comprising a first pair of rollers forming a nip for passage of a continuous length of fiber to be drafted;

an operative unit for feeding a continuous length of fiber to said nip of said first pair of rollers, said unit including a rotatably mounted large friction roller and an endless apron opposite said roller for guiding the length of fiber therebetween; and a guide element interposed between said pair of rollers and said unit for guiding the length of fiber to said nip, said guide element being spaced from said roller of said operative unit to strip the length of fiber therefrom for conveyance to said nip of said first pair of rollers.

* * * * *